US009310749B2

(12) United States Patent
Saito et al.

(10) Patent No.: US 9,310,749 B2
(45) Date of Patent: Apr. 12, 2016

(54) IMAGE FORMING APPARATUS AND IMAGE FORMING METHOD

(71) Applicant: KONICA MINOLTA, INC., Tokyo (JP)

(72) Inventors: Hiroyuki Saito, Tokyo (JP); Shunichi Takaya, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/717,943

(22) Filed: May 20, 2015

(65) Prior Publication Data

US 2015/0338818 A1 Nov. 26, 2015

(30) Foreign Application Priority Data

May 26, 2014 (JP) ..... 2014-108559

(51) Int. Cl.
*G03G 21/00* (2006.01)
*G03G 15/16* (2006.01)
*G03G 15/00* (2006.01)

(52) U.S. Cl.
CPC ..... *G03G 21/00* (2013.01); *G03G 15/161* (2013.01); *G03G 15/6588* (2013.01); *G03G 2215/00464* (2013.01)

(58) Field of Classification Search
None
See application file for complete search history.

(56) References Cited

U.S. PATENT DOCUMENTS

2002/0176059 A1* 11/2002 Lucey et al. ..... 355/40
2008/0112718 A1* 5/2008 Akashi et al. ..... 399/49
2011/0226061 A1* 9/2011 Itsumi et al. ..... 73/589

FOREIGN PATENT DOCUMENTS

EP 1813559 A2 1/2007
JP 2004-226824 8/2004
JP 2004-226824 A * 8/2004 ..... G03G 15/00

OTHER PUBLICATIONS

Extended European Search Report for European Application No. 15168510.4, dated Oct. 2, 2015.

* cited by examiner

*Primary Examiner* — Clayton E Laballe
*Assistant Examiner* — Jas Sanghera
(74) *Attorney, Agent, or Firm* — Squire Patton Boggs (US) LLP

(57) ABSTRACT

An image forming apparatus of the present invention includes an image carrying member capable of carrying an image, a paper conveying unit, a foreign matter detection unit, and a toner layer forming unit. The paper conveying unit conveys a paper to the image carrying member. The foreign matter detection unit detects a foreign matter projecting from the end portion of the paper. The toner layer forming unit forms a toner layer on the surface of the image carrying member in response to a position of the foreign matter detected by the foreign matter detection unit.

20 Claims, 9 Drawing Sheets

IMAGE FORMING APPARATUS AND IMAGE FORMING METHOD

CROSS-REFERENCE TO RELATED APPLICATION

This application is based on Japanese Patent Application No. 2014-108559 filed on May 26, 2014, the contents of which are incorporated herein by reference.

BACKGROUND

1. Technical Field

The present invention relates to an image forming apparatus and an image forming method.

2. Description of Related Arts

There has been developed an image forming apparatus capable of coping with various types of papers such as a long paper (for example, a roll-to-roll paper) wound in a roll shape or a so-called label paper attachable as a seal as well as a generally used paper having an A4 size, a B5 size, etc.

When an image is printed in an image forming apparatus by using such a special paper, material of a paper may project from the end portion of the paper. For example, when an image is printed on a label paper including an adhesive such as a paste, it is probable that the adhesive projects from the end portion of the paper, and is transferred to and is attached to an intermediate transfer belt. Furthermore, when the label paper is long, since a part including the adhesive is long, it is probable that the adhesive is transferred and attached to the intermediate transfer belt.

Furthermore, for example, when a long paper such as a roll-to-roll paper has been cut, cutting waste may be attached to the end portion of the paper. It is probable that the cutting waste attached to the end portion of the paper is peeled off and is attached to an intermediate transfer belt.

When the adhesive, the cutting waste, etc., are transferred and attached to the intermediate transfer belt, for example, a primary transfer unit, a secondary transfer unit, and a cleaning device associated with these units may be abnormally worn, or failure may occur when a toner image is transferred.

In this regard, a technology, which has a purpose of preventing the attachment of an adhesive to a photoreceptor with respect to a label paper including the adhesive in an image forming apparatus employing a direct transfer scheme, is disclosed in Japanese Unexamined Publication No. 2004-226824. In Japanese Unexamined Publication No. 2004-226824, after an external additive having a polarity opposite to toner is supplied, the separate external additive not attached to a toner surface is allowed to be attached to a non-image area of a photoreceptor so as to be developed, and is allowed to be interposed between the paper and the photoreceptor, so that the adhesive is prevented from being attached to the photoreceptor.

However, since the amount of particles of the separate external additive not attached to the toner surface is small, the amount of particles of the external additive attached to the non-image area of the photoreceptor is also small. As a consequence, there is a problem that the effect of preventing the adhesive from being attached to the photoreceptor is small.

The present invention is intended to solve the aforementioned problems, and one of the objectives of the present invention is to provide an image forming apparatus and an image forming method, by which it is possible to more reliably prevent a foreign matter projecting from the end portion of a paper from being attached to a member of a transfer unit.

SUMMARY

In order to achieve at least one of the aforementioned objectives, an image forming apparatus, reflecting one aspect of the present invention, comprises: an image carrying member capable of carrying an image; a paper conveying unit for conveying a paper to said image carrying member; a foreign matter detection unit for detecting a foreign matter projecting from an end portion of said paper; and a toner layer forming unit for forming a toner layer on a surface of said image carrying member in response to a position of said foreign matter detected by said foreign matter detection unit.

Preferably, said image forming apparatus further comprises a transfer unit for conveying said paper in press-contact with said image carrying member with said formed image and toner layer and transferring said image to said paper.

Preferably, said a distance from said foreign matter detection unit to a nip portion of said transfer unit is longer than a distance from an image writing position to said image carrying member at a lowermost downstream side to said nip portion.

Preferably, said foreign matter detection unit acquires information including at least one of a width, a length, and an amount of said foreign matter projecting from said end portion of said paper, and said toner layer forming unit interprets said information and decides at least one of a width, a length, and a thickness of a toner layer to be formed.

Preferably, said foreign matter detection unit includes an optical sensor, and optically detects said foreign matter projecting from said end portion of said paper.

Preferably, said foreign matter detection unit includes a rotating member, said rotating member is rotatably installed along said end portion of said paper, and said foreign matter detection unit detects said foreign matter projecting from said end portion of said paper based on a number of rotations of said rotating member.

Preferably, said toner layer forming unit forms a toner layer having a predetermined width at an outer side of said paper from a position corresponding to said end portion of said paper in said surface of said image carrying member.

Preferably, said toner layer forming unit forms a toner layer from an inner side to an outer side across said position corresponding to said end portion of said paper in said surface of said image carrying member.

Preferably, said toner layer forming unit forms a single layer of toner layer or a plurality of stacked toner layers.

Preferably, said toner layer forming unit forms a large number of stacked toner as it goes toward said position corresponding to said end portion of said paper in said surface of said image carrying member.

Preferably, said toner layer forming unit forms said toner layer by using toner of a color with a small consumption amount.

Preferably, said image carrying member includes an intermediate transfer belt.

Preferably, said image carrying member includes a photosensitive drum.

Preferably, said paper includes an adhesive layer.

The objectives, features, and characteristics of this invention other than those set forth above will become apparent from the description given herein below with reference to preferred embodiments illustrated in the accompanying drawings.

DETAILED DESCRIPTION

Figure 1:
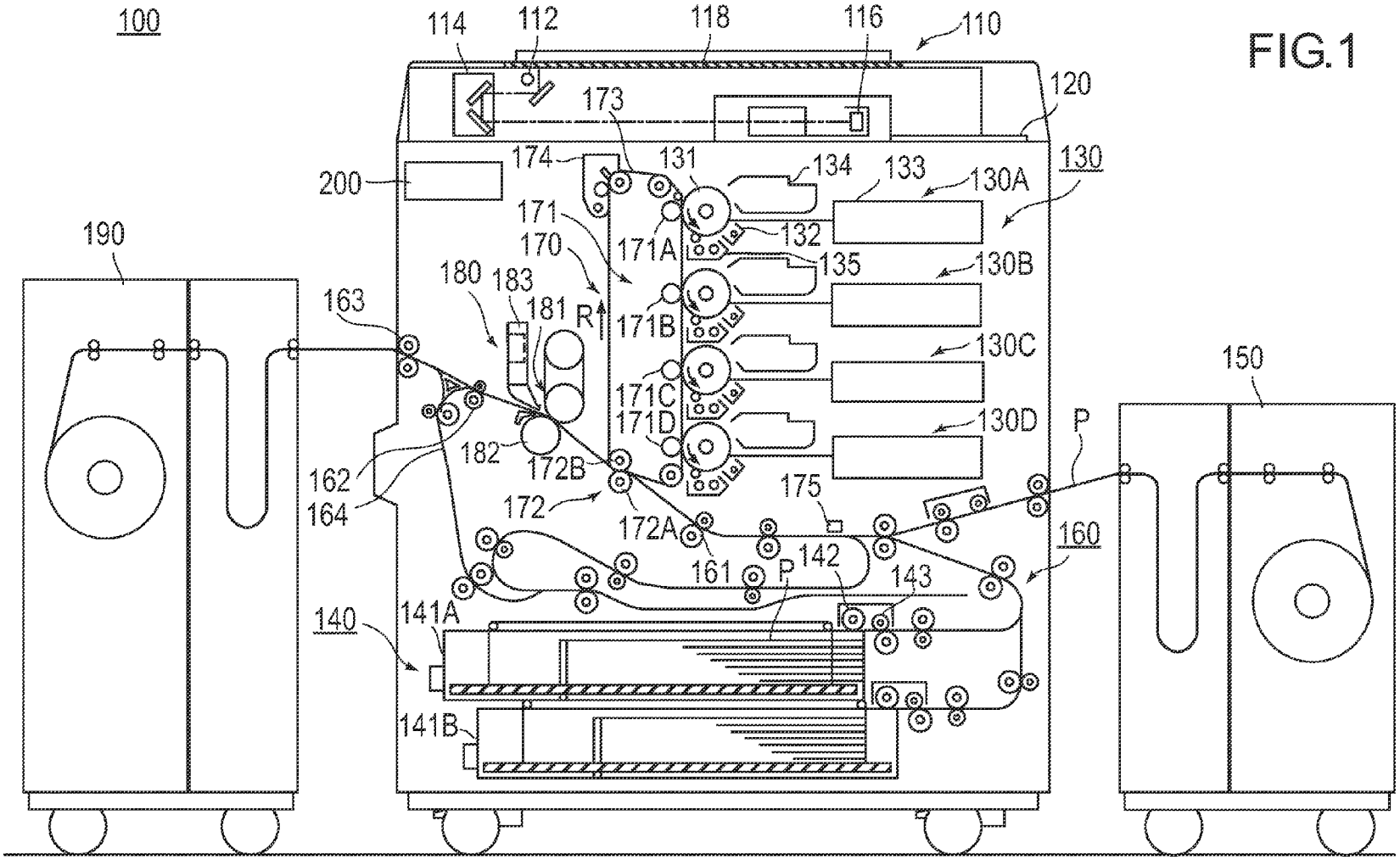
FIG. 1 is a schematic sectional view showing the entire structure of an image forming apparatus in a first embodiment of the present invention.

The embodiments of this invention will be described below with reference to the accompanying drawings. In addition, in a description of the drawings, the same reference numerals are used to designate the same elements and a redundant description will be omitted. Furthermore, the dimension ratio of each drawing is exaggerated for the sake of description, and may differ from an actual ratio.

First Embodiment

Figure 2:
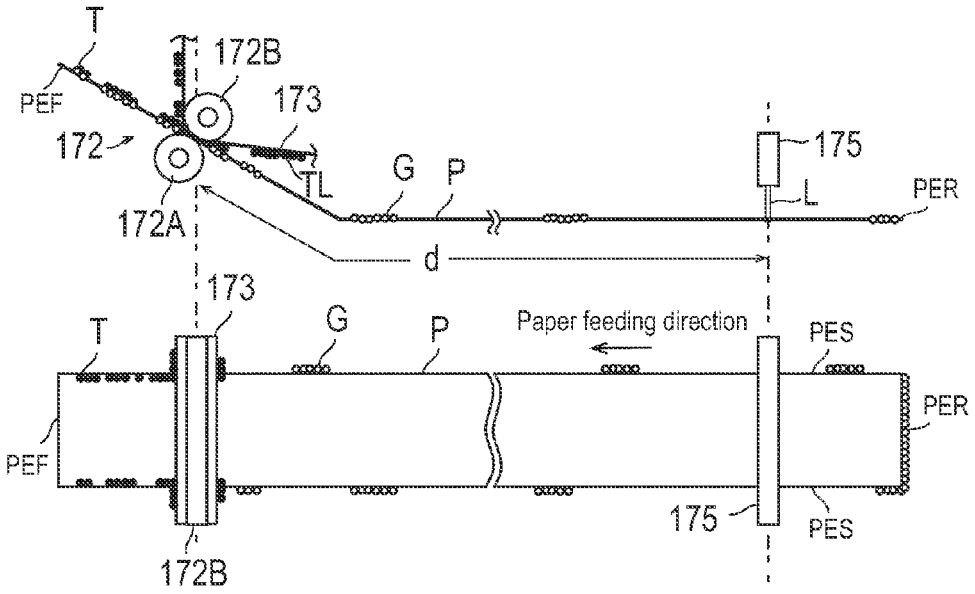
FIG. 2 is a schematic diagram for explaining a detection unit shown in FIG. 1.
Figure 3:
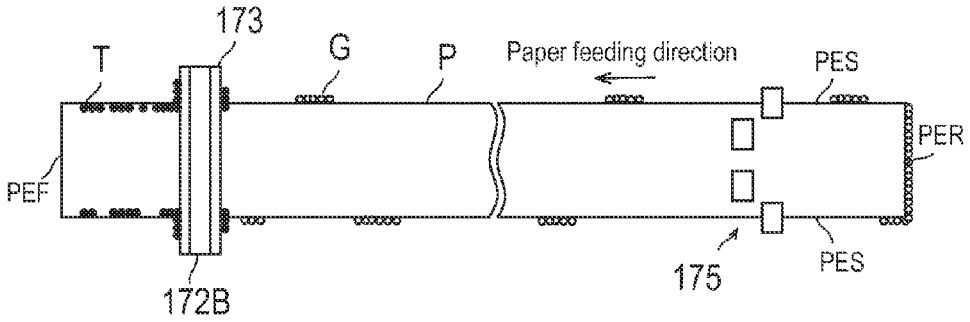
FIG. 3 is a schematic diagram showing a modification example of a detection unit shown in FIG. 1.

FIG. 1 is a schematic sectional view showing the entire structure of an image forming apparatus in a first embodiment of the present invention, FIG. 2 is a schematic diagram for explaining a detection unit shown in FIG. 1, and FIG. 3 is a schematic diagram showing a modification example of a detection unit shown in FIG. 1.

An image forming apparatus 100 includes an image reading unit 110, an operation display unit 120, an image forming unit 130, a first paper feeding unit 140, a second paper feeding unit 150, a paper conveying unit 160, a transfer unit 170, a detection unit 175, a fixing unit 180, a paper discharge unit 190, and a control unit 200.

The image forming apparatus 100 has a function of preventing a foreign matter (hereinafter, referred to as a "foreign matter projecting from the end portion of a paper") such as an adhesive projecting from the end portion of the paper or cutting waste attached to the end portion of the paper from being attached to a member of the transfer unit 170. In the present embodiment, the case in which an adhesive serving as a foreign matter projects from the end portion of the paper will be described as one example.

<Image Reading Unit>

The image reading unit 110 generates image data of a document. The image reading unit 110 includes a light source 112, an optical system 114, an imaging element 116, and a reading surface 118. The light source 112 irradiates light onto a document placed on the reading surface 118, and an image of reflected light is formed on the imaging element 116, which has moved to a reading position, via the optical system 114. The imaging element 116, for example, includes a line image sensor, and generates an electrical signal in response to reflected light intensity. The generated electrical signal is subjected to A/D conversion, shading correction, filter processing, image compression processing, etc., and then is input to the image forming unit 130.

<Operation Display Unit>

The operation display unit 120 has a function of receiving input by a user and a function of outputting data and various types of information to a screen. The operation display unit 120 includes an input device such as a touch panel, a keyboard, and a mouse and an output device such as a display. The operation display unit 120, for example, receives a print instruction, various types of setting, etc., from a user through the touch panel or the keyboard, and displays a progress status of a print job, an occurrence status of an error, a current status of various types of setting, etc., on the screen of the display.

In the present embodiment, the image forming apparatus 100 has a function of preventing an adhesive projecting from a paper from being attached to the member of the transfer unit 170, and can set whether to validate or invalidate the function via the operation display unit 120.

<Image Forming Unit>

The image forming unit 130 forms a toner image on a photosensitive drum serving as an image carrying member by using an electrophotographic process. Furthermore, as will be described later, the image forming unit 130 of the present embodiment forms a toner layer on the surface of the photosensitive drum according to an instruction of the control unit 200. The image forming unit 130 serves as a toner layer forming unit.

The image forming unit 130 includes an image forming unit 130A for forming an image of a yellow (Y) color, an image forming unit 130B for forming an image of a magenta (M) color, an image forming unit 130C for forming an image of a cyan (C) color, and an image forming unit 130D for forming an image of a black (K) color.

Each of the image forming units 130A to 130D includes a photosensitive drum 131, a charging unit 132, an optical writing unit 133, a developing device 134, and a photoreceptor cleaning unit 135.

The photosensitive drum 131 is an image carrying member having a photosensitive layer made of resin such as polycarbonate including an OPC (Organic Photo Conductor), and is configured to rotate at a predetermined speed in an arrow direction shown in FIG. 1.

The charging unit 132 includes a corona discharge electrode arranged in the vicinity of the photosensitive drum 131, and charges the surface of the photosensitive drum 131 by a generated ion.

The optical writing unit 133 forms a charge pattern corresponding to image data in the photosensitive drum 131. The optical writing unit 133 includes a scanning optical device, and exposes the charged photosensitive drum 131 based on the image data, thereby reducing the potential of an exposed part and forming the charge pattern (an electrostatic latent image) corresponding to the image data. In the present specification, a position, in which the optical writing unit 133 exposes the photosensitive drum 131 and writes the image data, will be referred to as an "image writing position".

The developing device 134, for example, is a 2-ingredient reverse rotation developing device, develops the electrostatic late n t image formed on the photosensitive drum 131, and visualizes the electrostatic late n t image by toner. On the photosensitive drum 131 of each of the image forming units 130A, 130B, 130C, and 130D, a monochromatic toner image corresponding to a yellow color, a magenta color, a cyan color, and a black color is formed. In addition, a grain size of the toner used in the present embodiment, for example, is about 6 μm.

The photoreceptor cleaning unit 135 cleans the surface of the photosensitive drum 131. In more detail, after the toner image is transferred to an intermediate transfer belt 173 to be described later, the photoreceptor cleaning unit 135 scrapes (removes) residual material such as toner and an external additive remaining on the surface of the photosensitive drum 131, thereby maintaining a clean surface state.

<First Paper Feeding Unit>

The first paper feeding unit 140 and the second paper feeding unit 150 hold papers P on which an image is to be printed, and supplies the papers P to the transfer unit 170.

The first paper feeding unit 140 includes paper trays 141A and 141B, a delivery roller 142, and a separation roller 143. The paper trays 141A and 141B accommodate generally used papers having an A4 size, an A3 size, a B5 size, etc. The delivery roller 142 and the separation roller 143 send the papers P from the paper trays 141A and 141B to a conveyance path one by one.

<Second Paper Feeding Unit>

The second paper feeding unit 150 supplies a long paper P. In the present embodiment, the paper P, for example, may be a roll paper for label print (hereinafter, simply referred to as a "label paper"). The paper P is wound around a support axis so as to be rotatably held, and is conveyed at a constant speed by a plurality of paper feeding rollers. In addition, in the present embodiment, the paper P is held in a roll shape. However, the paper P is not always needed to be held in the roll shape, and may be folded and held. Furthermore, FIG. 1 shows only one roll-shaped paper P; however, a plurality of roll-shaped papers P may be held.

<Paper Conveying Unit>

The paper conveying unit 160 conveys the paper P. The paper conveying unit 160 has a plurality of conveying rollers including a resist roller 161, a fixing conveyance roller 162 and a paper discharge roller 163, and a paper reversing unit 164. The paper P is conveyed to the transfer unit 170, the fixing unit 180, and the paper discharge unit 190 by the plurality of conveying rollers.

In more detail, the resist roller 161 conveys the paper P, which has been fed from the first paper feeding unit 140 or the second paper feeding unit 150, to the transfer unit 170. Furthermore, the fixing conveyance roller 162 conveys the paper P, which has passed through the transfer unit 170 and the fixing unit 180, toward the paper discharge roller 163. Moreover, the paper discharge roller 163 conveys the paper P, on which the toner image has been fixed by the fixing unit 180, to the paper discharge unit 190.

The paper reversing unit 164 is used in order to reverse and discharge the front and the back of the paper P, or to form an image on both surfaces of the paper P. The paper reversing unit 164 introduces the paper P, which has been supplied from the first paper feeding unit 140 and passed through the fixing conveyance roller 162, to a conveyance path between the paper trays 141A and 141B and the paper discharge roller 163, but not to a conveyance path directed to the paper discharge roller 163.

<Transfer Unit>

The transfer unit 170 transfers the toner image to the paper P. The transfer unit 170 includes a primary transfer unit 171, a secondary transfer unit 172, the intermediate transfer belt 173, and an intermediate transfer cleaning unit 174.

The primary transfer unit 171 transfers the toner image formed on the photosensitive drum 131 to the intermediate transfer belt 173. The primary transfer unit 171 includes primary transfer modules 171A, 171B, 171C, and 171D respectively corresponding to a yellow color, a magenta color, a cyan color, and a black color. The primary transfer modules 171A to 171D are arranged at predetermined intervals along the intermediate transfer belt 173 such that the primary transfer module 171A is arranged at the uppermost upstream side with respect to a rotation direction of the intermediate transfer belt 173 and the primary transfer module 171D is arranged at the lowermost downstream side.

In the present embodiment, as will be described later, the primary transfer unit 171 also plays a role of transferring a toner layer formed on the photosensitive drum 131 to the intermediate transfer belt 173. The primary transfer unit 171 serves as a toner layer forming unit.

The secondary transfer unit 172 transfers the toner image transferred to the intermediate transfer belt 173 to the paper P. In the present embodiment, the secondary transfer unit 172 includes a secondary transfer roller 172A and a secondary transfer opposing roller 172B. The secondary transfer unit 172 conveys the paper P in press-contact with the intermediate transfer belt 173 with the formed toner image and toner layer by the secondary transfer roller 172A and the secondary transfer opposing roller 172B, thereby transferring the toner image to the paper P. In addition, a distance between the secondary transfer unit 172 and the intermediate transfer belt 173 is positioned such that the paper P can pass through therebetween.

As described above, the toner images of each color formed in the image forming units 130A to 130D are sequentially transferred onto the intermediate transfer belt 173 by the primary transfer modules 171A to 171D. Then, a toner image of a color, in which layers of the yellow color, the magenta color, the cyan color, and the black color have been superimposed, is formed and is transferred to the conveyed paper P by the secondary transfer unit 172.

The intermediate transfer belt 173 serves as an image carrying member and is configured to be able to carry the toner image transferred in the primary transfer unit 171. The intermediate transfer belt 173 is an endless belt, is wound by a plurality of rollers, and is supported to be travelable. The paper P is conveyed to the intermediate transfer belt 173 by the paper conveying unit 160.

The intermediate transfer belt 173 travels by rotating in a direction (a clockwise direction on the plane) indicated by an arrow R of FIG. 1 under the control of the control unit 200. In addition, in the following description, a direction in which the intermediate transfer belt 173 rotates when an image formation is performed in the image forming apparatus 100 will be referred to as a "rotation direction" of the intermediate transfer belt 173. Furthermore, the intermediate transfer cleaning unit 174 removes toner remaining on the intermediate transfer belt 173.

<Foreign Matter Detection Unit>

The detection unit 175 has a reflective type optical sensor, and detects an adhesive projecting from the end portion of the paper P in cooperation with the control unit 200. The detection unit 175 serves as a foreign matter detection unit together with the control unit 200.

As shown in FIG. 2, the optical sensor of the detection unit 175 has a light emitting unit and a light receiving unit (not shown), and is installed at a position of a distance d along a conveyance path of the paper P from the nip portion of the secondary transfer unit 172. The distance d is at least longer than a distance from an image writing position to the photosensitive drum 131 of the lowermost downstream side corresponding to a black color to the nip portion of the secondary transfer unit 172, and is preferably longer than a distance from the image writing position to the photosensitive drum 131 of the uppermost upstream side corresponding to a yellow color to the nip portion.

The light emitting unit irradiates laser light L toward the paper conveyance path according to an instruction of the control unit 200. The light emitting unit has a light emitting surface with a length in the width direction of the paper P longer than the width of the paper P, and is arranged in a position spaced apart from the conveyance path by a predetermined distance at one surface side of the paper P conveyed through the conveyance path.

The light receiving unit receives reflected light of the laser light L irradiated from the light emitting unit, and transmits alight receiving signal according to light intensity to the control unit 200. The light receiving unit has a light receiving surface having a size corresponding to the light emitting surface of the light emitting unit and an image sensor. The image sensor includes a plurality of light receiving elements arranged in at least one row in the width direction of the paper P, and detects light passing through the light receiving surface. The light receiving unit is arranged at the same side as that of the light emitting unit with respect to the conveyance path.

In addition, as shown in FIG. 3, the detection unit 175 may include a plurality of small optical sensors. The plurality of small optical sensors are arranged in positions different from one another in the width direction of the paper p in order to be able to cope with paper sizes different from one another. In this way, the small optical sensors are used, so that it is possible to suppress cost as compared with the case of using one large optical sensor.

<Fixing Unit>

The fixing unit 180 fixes the toner image transferred to the paper P. The fixing unit 180 includes a heating roller 181, a pressing roller 182, and a paper separation unit 183.

The heating roller 181 conveys and heats the paper P with the transferred toner image. The pressing roller 182 conveys and presses the paper P with the transferred toner image. The heating roller 181 and the pressing roller 182 serve as a fixing member.

The paper separation unit 183 separates a paper from the heating roller 181. The paper separation unit 183 includes a blowing fan and a nozzle. The speed of air sent from the blowing fan increases in the interior of the nozzle, and the air is injected toward the paper P of a paper outlet of a nip portion of the fixing unit 180. As a consequence, the paper P is separated from the heating roller 181.

<Paper Discharge Unit>

The paper discharge unit 190 discharges the paper P conveyed from the fixing unit 180. In detail, the paper discharge unit 190 winds the paper P conveyed from the fixing unit 180 around a support axis at a constant speed by a plurality of rollers. In addition, the paper P of the paper discharge unit 190 is not always needed to be held in a roll shape, and may be cut in each page.

<Control Unit>

The control unit 200 is connected to the image reading unit 110, the operation display unit 120, the image forming unit 130, the first paper feeding unit 140, the second paper feeding unit 150, the paper conveying unit 160, the transfer unit 170, the detection unit 175, the fixing unit 180, and the paper discharge unit 190, and controls each of these elements.

The control unit 200 includes a CPU (Central Processing Unit), a HDD (Hard Disk Drive), a RAM (Random Access Memory), and a ROM (Read Only Memory) (not shown).

The CPU executes a control program to control the aforementioned each element. The HDD is a storage device with large capacity, and preserves various programs such as the control program and application software, various types of setting information, etc. In the present embodiment, paper width information and toner use history are also preserved in the HDD. The RAM temporarily stores the control program and an operation result. Furthermore, the ROM stores parameters required when the CPU executes the control program, and various pieces of data. An image forming method of the present embodiment, which will be described below, is realized when the CPU executes the control program and thus the aforementioned each element is controlled.

Based on a light receiving signal from the detection unit 175 when the paper P passes through the detection unit 175, the control unit 200 calculates reflection intensity (or reflectance) in each position in the width direction of the paper P, and detects an adhesive projecting from the end portion of the paper P from a difference of the reflection intensities. In addition, the end portion of the paper P of the present embodiment includes a front end portion PEF, a side end portion PES, and a rear end portion PER. The control unit 200 calculates the positions of the front end portion PEF, the side end portion PES, and the rear end portion PER of the paper P on the surface of the intermediate transfer belt 173.

In the present embodiment, the detection unit 175 and the control unit 200 serve as a foreign matter detection unit. The foreign matter detection unit acquires information including at least one of a width, a length, and an amount of the adhesive projecting from the end portion of the paper P.

Furthermore, in the present embodiment, the image forming unit 130, the transfer unit 170, and the control unit 200 serve as a toner layer forming unit. The toner layer forming unit interprets the information, decides at least one of a width, a length, and a thickness of a toner layer to be formed, and forms a toner layer on the surface of the intermediate transfer belt 173.

<Image Forming Method>

Figure 4:
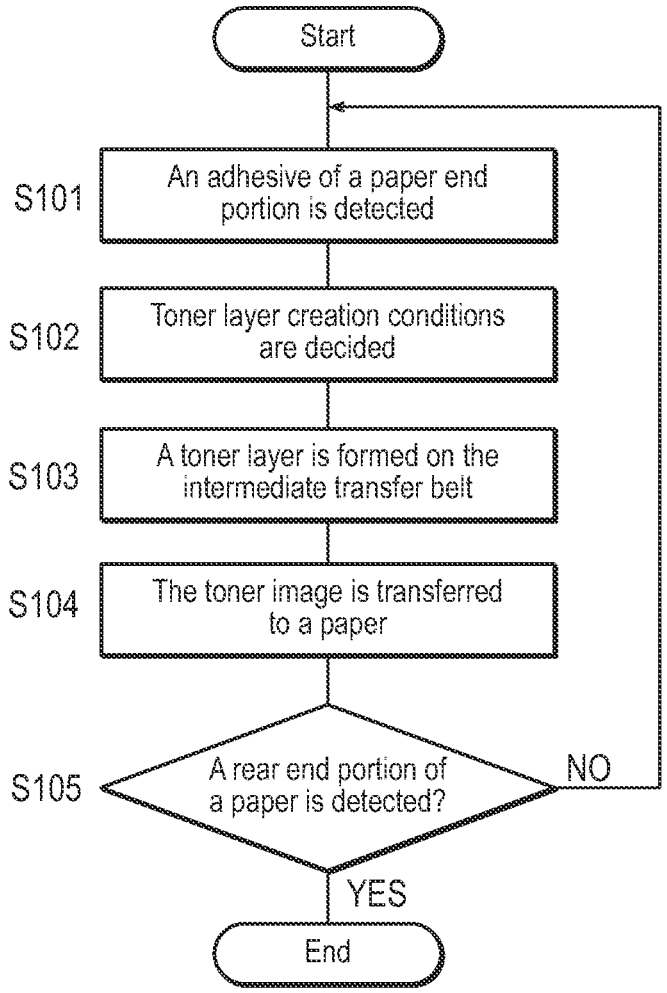
FIG. 4 is a flowchart for explaining an image forming method in a first embodiment of the present invention.

Next, with reference to FIG. 4, FIG. 5A and FIG. 5B, and FIG. 6A to FIG. 6D, an image forming method of the first embodiment of the present invention will be described. FIG. 4 is a flowchart for explaining the image forming method of the first embodiment of the present invention.

Figure 5A:
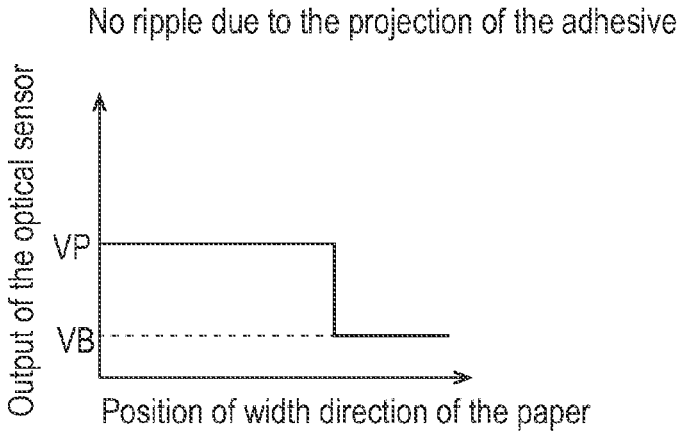
FIG. 5A is a diagram showing one example of output of an optical sensor when there is no adhesive in a paper end portion in a first embodiment of the present invention.
Figure 5B:
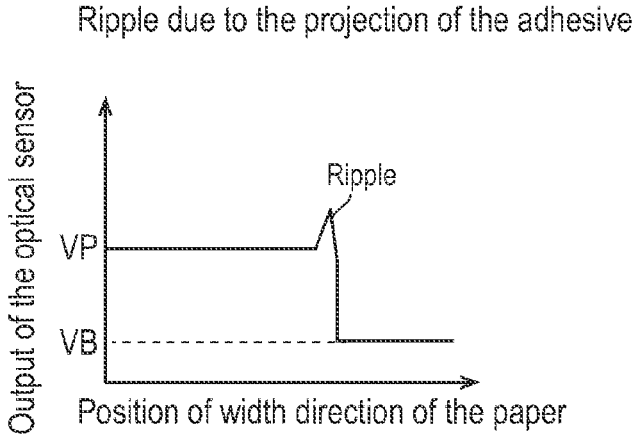
FIG. 5B is a diagram showing one example of output of an optical sensor when there is an adhesive in a paper end portion in a first embodiment of the present invention.

Furthermore, FIG. 5A is a diagram showing one example of the output of the optical sensor when there is no adhesive in the paper end portion in the first embodiment of the present invention, and FIG. 5B is a diagram showing one example of the output of the optical sensor when there is an adhesive in the paper end portion in the first embodiment of the present invention. In FIG. 5A and FIG. 5B, a horizontal axis indicates a position of an end direction from a center portion of a paper, and a vertical axis indicates the output (the light receiving signal) of the optical sensor in the position.

Figure 6A:
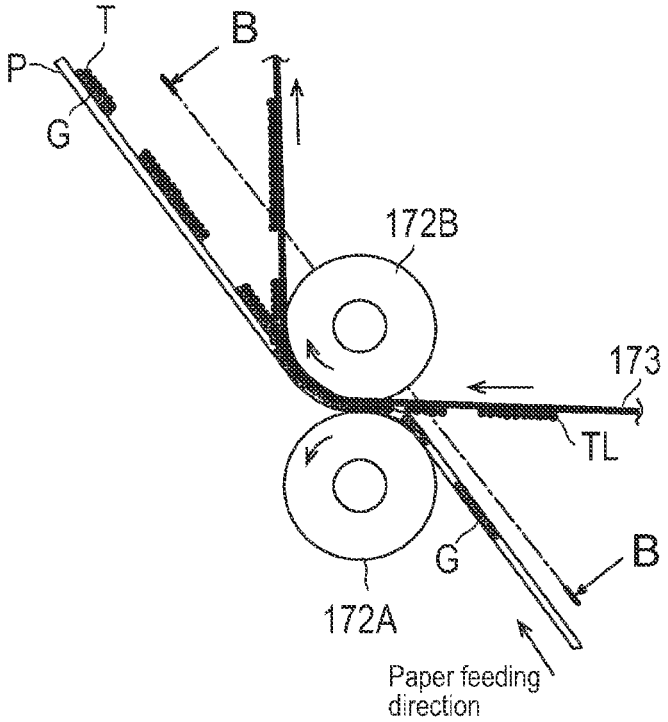
FIG. 6A is a sectional view for explaining the formation of a toner layer in a first embodiment of the present invention.
Figure 6B:
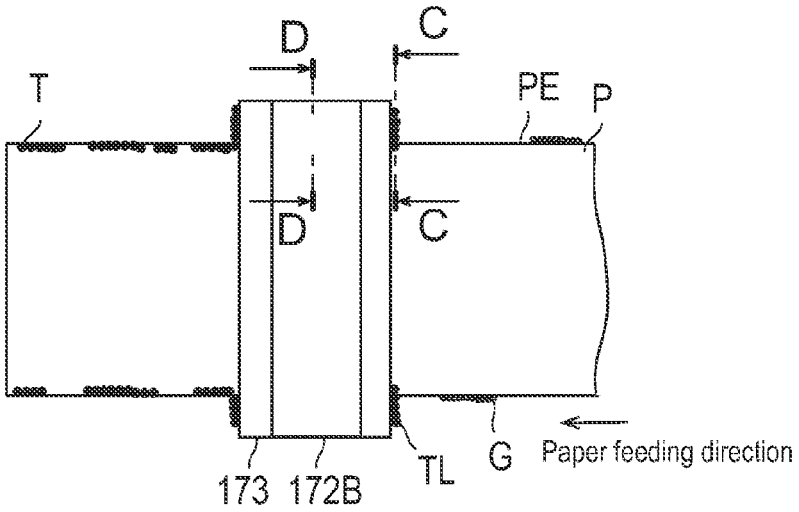
FIG. 6B is a sectional view taken along line B-B of FIG. 6A.
Figure 6C:
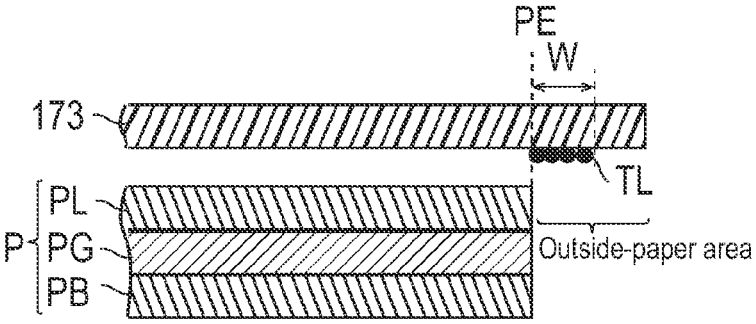
FIG. 6C is a sectional view taken along line C-C of FIG. 6B.
Figure 6D:
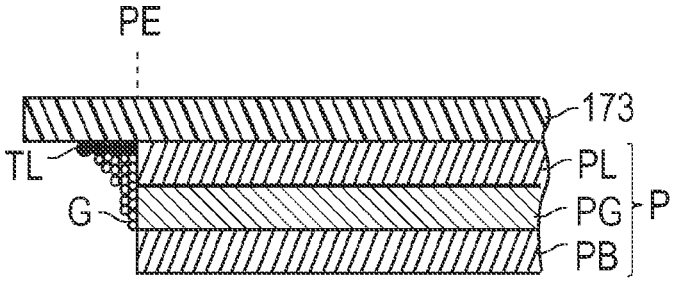
FIG. 6D is a sectional view taken along line D-D of FIG. 6B.

Furthermore, FIG. 6A is a sectional view for explaining the formation of a toner layer in the first embodiment of the present invention, FIG. 6B is a sectional view taken along line B-B of FIG. 6A, FIG. 6C is a sectional view taken along line C-C of FIG. 6B, and FIG. 6D is a sectional view taken along line D-D of FIG. 6B.

As shown in FIG. 4, firstly, an adhesive of a paper end portion is detected (step S101). The control unit 200 controls the second paper feeding unit 150 and the paper conveying unit 160 to convey the paper P toward the transfer unit 170 and operate the detection unit 175. The control unit 200 interprets the light receiving signal from the detection unit 175, and detects an adhesive projecting from the end portion of the paper P based on the interpretation result.

In detail, as shown in FIG. 5A, when no adhesive projects from the end portion of the paper P, the output of the optical sensor for the surface of the paper P is VP. Furthermore, the output of the optical sensor for an outside-paper area, i.e. an area in which the surface of the intermediate transfer belt 173 is exposed because there is no paper P, is VB.

On the other hand, as shown in FIG. 5B, when an adhesive projects from the end portion of the paper P, the output of the optical sensor of the detection unit 175 may include a ripple due to the projection of the adhesive in a position corresponding to the end portion of the paper P. This is because the output of the optical sensor is larger than VP because the reflectance of the adhesive is higher than the reflectance of the paper P at apart in which the adhesive projects from the end portion of the paper P. The control unit 200 determines that the adhesive exists in the part in which the output of the optical sensor is larger than VP, that is, the part including the ripple, and calculates a width of the ripple. The width of the ripple corresponds to the width of the adhesive.

Next, toner layer creation conditions are decided (step S102). The toner layer creation conditions include a position, a width, and a length of a toner layer when the toner layer is created, a color of toner to be used, etc. When it is determined that there is the adhesive, the control unit 200 decides the toner layer creation conditions based on the paper width information and the toner use history preserved in the HDD of the control unit 200, and a position, a length, a width, and an amount of the detected adhesive.

For example, the position, the width, and the length of the toner layer may be decided to be respectively proportional to the position, the width, and the length of the adhesive. Furthermore, a thickness of the toner layer may be decided to be proportional to the amount of the adhesive. Moreover, the color of the toner may be decided based on the toner use history.

Next, a toner layer is formed on the intermediate transfer belt (step S103). When it is determined that there is the adhesive, the control unit 200 controls the image forming unit 130 to form the toner layer on the intermediate transfer belt 173 under the creation conditions.

In more detail, the optical writing unit 133 forms an electrostatic latent image corresponding to image data, and forms an electrostatic latent image corresponding to the toner layer on the photosensitive drum 131 based on the calculated position corresponding to the end portion.

The developing device 134 develops the electrostatic latent image formed on the photosensitive drum 131, thereby forming a toner image and the toner layer corresponding to the image data. Moreover, the toner image and the toner layer formed on the photosensitive drum 131 are transferred to the intermediate transfer belt 173 by the primary transfer unit 171.

Next, the toner image is transferred to a paper (step S104). As shown in FIG. 6A and FIG. 6B, the paper P is conveyed in press-contact with the intermediate transfer belt 173 with the formed toner image along a paper feeding direction indicated by an arrow, so that the toner image is transferred to the paper P.

In the present embodiment, the toner layer has been formed on the surface of the intermediate transfer belt 173 in response to the position of the adhesive detected by the foreign matter detection unit. Consequently, the adhesive projecting from the end portion of the paper P is attached to the toner layer of the intermediate transfer belt 173, and is transferred to the paper P as is together with the toner layer. As a consequence, the adhesive projecting from the paper P is not attached to the surface of the intermediate transfer belt 173.

On the other hand, a toner layer TL not transferred to the paper P remains attached to the intermediate transfer belt 173, is delivered to a downstream side in the rotation direction of the intermediate transfer belt 173, and is removed by the intermediate transfer cleaning unit 174.

Hereinafter, with reference to FIG. 6C and FIG. 6D, the principle in which in the transfer unit 170 of the present embodiment, the adhesive projecting from the paper P is prevented from being attached to the member of the transfer unit 170 will be described in detail.

As shown in FIG. 6C, in the present embodiment, on a surface of an outside-paper area of the intermediate transfer belt 173, a toner layer TL decided under the creation conditions is formed in one layer at an outer side of the paper P from a position corresponding to the end portion PE of the paper P. In addition, in an image area of the surface of the intermediate transfer belt 173, the toner image has been formed, but is not shown. The paper P of the present embodiment is a label paper, and includes a pasteboard PB, an adhesive layer PG formed on the pasteboard PB, and a release paper PL formed on the adhesive layer PG.

As shown in FIG. 6D, when the toner image of the intermediate transfer belt 173 is transferred to the paper P, constant pressure is applied to the paper P by the secondary transfer roller 172A and the secondary transfer opposing roller 172B. As a consequence, it is probable that an adhesive G projecting from the end portion PE of the paper P moves to the intermediate transfer belt 173 through the paper end portion PE.

However, in the present embodiment, since the toner layer TL is formed on the surface of the intermediate transfer belt 173 in response to the position of the adhesive detected by the foreign matter detection unit, the adhesive G projecting from the end portion PE of the paper P is attached to the toner layer TL and is transferred onto the paper P. Consequently, it is possible to reliably prevent the adhesive G projecting from the end portion PE of the paper P from being attached to the surface of the intermediate transfer belt 173. As a consequence, it is possible to prevent image failure due to the attachment of the adhesive G to the intermediate transfer belt 173.

Furthermore, it is not necessary to clean or exchange a member due to the attachment of the adhesive G. Moreover, since no toner layer is formed in a position in which no adhesive is detected, the amount of toner to be used in the formation of the toner layer is minimally suppressed.

In addition, toner to be used to form the toner layer TL may have any color of YMCK, but it is preferable that toner of a color with a small consumption amount (i.e. a low print coverage) is preferentially used in the formation of the toner layer TL. The toner of the color with the low print coverage is preferentially used in the formation of the toner layer TL, so that discharge of deteriorated toner is promoted and thus it is possible to uniformly maintain the quality of toner held by the developing device 134 of a print coverage.

Furthermore, in the present embodiment, as described above, toner T may be attached to the end portion of the paper P with the transferred toner image. When the toner T is attached to the end portion of the paper P, the end portion of the paper P is colored with a color of the toner T. However, in the label paper, a release line for releasing a release paper is formed at the inner side of the end portion of the release paper in many cases, an inner portion of the release paper is used as a seal, and an outer portion of the release paper is typically discarded. Consequently, even though the end portion of the paper P with the transferred toner image is colored with the color of the toner T, since the outer portion of the release paper is discarded, there is no problem in many cases. When the end portion of the release paper is colored and a problem occurs, colorless toner may be provided to the image forming unit 130 in addition to the toner of YMCK, and the toner layer TL may be formed with the colorless toner.

Modification Example

Figure 7:
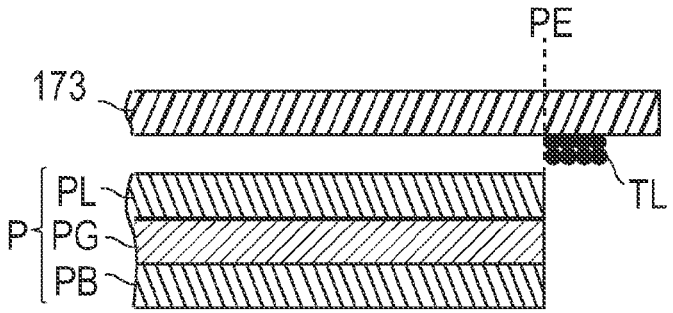
FIG. 7 is a sectional view for explaining a modification example of a toner layer in a first embodiment of the present invention.
Figure 8:
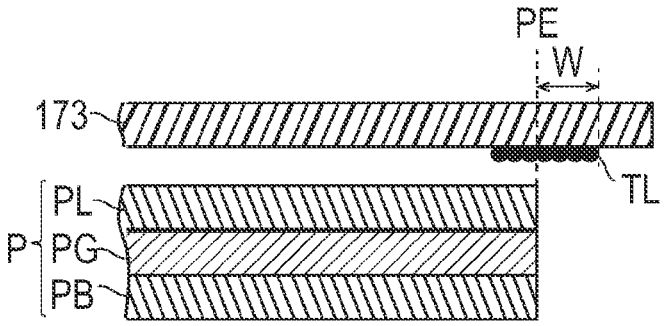
FIG. 8 is a sectional view for explaining a modification example of a toner layer in a first embodiment of the present invention.
Figure 9:
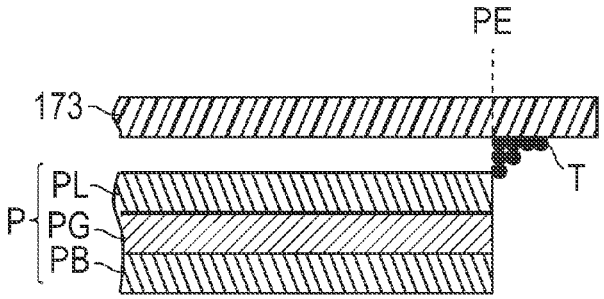
FIG. 9 is a sectional view for explaining a modification example of a toner layer in a first embodiment of the present invention.

In the examples shown in FIG. 6A to 6D, the case in which one layer (a single layer) of the toner layer TL is formed at the outer side of the paper P from the position corresponding to the end portion of the paper P has been described. However, the toner layer formation position and the number of stacked toner layers are not limited to the aforementioned case. FIG. 7 to FIG. 9 are sectional views for explaining modification examples of a toner layer in the first embodiment of the present invention.

As shown in FIG. 7, the toner layer forming unit may form a plurality of stacked toner layers. In this way, when a plurality of stacked toner layers TL are formed, since the number of toner particles adhering to the adhesive G increases, it is possible to more reliably suppress the transfer of the adhesive G to the intermediate transfer belt 173.

Furthermore, as shown in FIG. 8, the toner layer forming unit may form the toner layer from the inner side to the outer side across the position corresponding to the end portion PE of the paper P. In this way, the toner layer TL is formed, so that it is possible to more reliably suppress the transfer of the adhesive to the intermediate transfer belt 173. In detail, even though the amount of the adhesive G projecting from the paper P is large and the adhesive G projects into the inner side of the end portion PE of the paper P, it is possible to prevent the adhesive G from being attached to the intermediate transfer belt 173. Furthermore, even when a shift has occurred in the position of the end portion PE of the paper P in the secondary transfer unit 172, it is possible to prevent the adhesive projecting from the paper P from being attached to the intermediate transfer belt 173.

Moreover, as shown in FIG. 9, the toner layer forming unit may increase the number of stacked toner as it goes toward the position corresponding to the end portion PE of the paper P in the surface of the intermediate transfer belt 173. The number of stacked toner can be adjusted by changing the degree, in which the optical writing unit 133 exposes the photosensitive drum 131 in response to the position of the surface of the photosensitive drum 131, so as to change the amplitude of potential. In this way, the toner layer TL is formed, so that the number of toner particles in the vicinity of the end portion PE, from which a large amount of adhesive G projects, increases, and thus it is possible to further reliably suppress the transfer of the adhesive G to the intermediate transfer belt 173.

Second Embodiment

In the first embodiment, the case in which the adhesive projecting from the side end portion of the paper is detected from the difference between the reflectance of the paper and the reflectance of the adhesive by using the optical sensor has been described. In the second embodiment, the case in which the adhesive projecting from the end portion of the paper is detected from the difference of the number of rotations of a roller having a rotating surface rotating along the end portion of the paper when the adhesive exists and when the adhesive does not exist by using the roller will be described. Hereinafter, in order to avoid redundancy of a description, a description of the same configuration as that of the first embodiment will be omitted.

Figure 10:
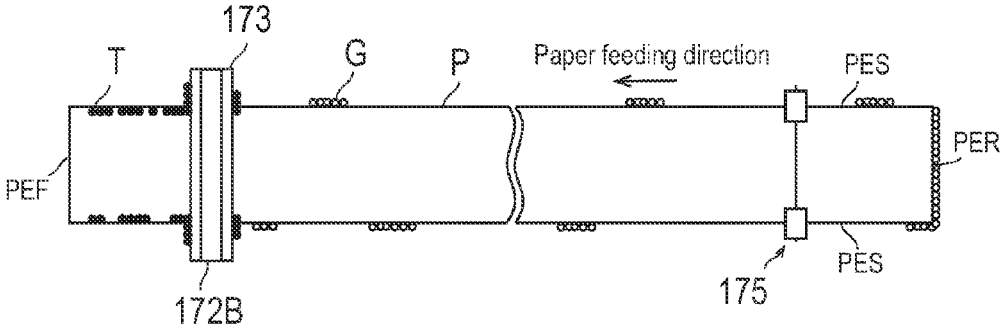
FIG. 10 is a schematic diagram showing the structure of an image forming apparatus in a second embodiment of the present invention.
Figure 11:
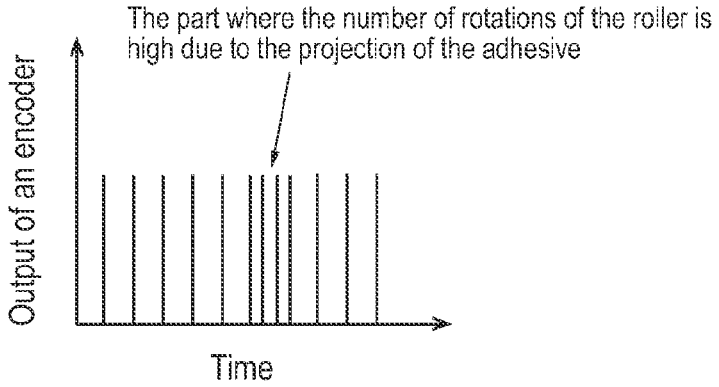
FIG. 11 is a diagram for explaining a method for detecting a foreign matter of a paper end portion in a second embodiment of the present invention.

FIG. 10 is a sectional view for explaining the formation of a toner layer of the second embodiment of the present invention, and FIG. 11 is a diagram for explaining a method for detecting an adhesive of a paper end portion in the second embodiment of the present invention. In FIG. 11, a horizontal axis indicates a time for which a roller travels along the side end portion PES of the paper P, and a vertical axis indicates the output of an encoder that detects the rotation of the roller.

As shown in FIG. 10, the detection unit 175 includes two rollers serving as a rotating member, and an encoder (not shown), and detects an adhesive projecting from the end portion of the paper P in cooperation with the control unit 200. The two rollers are rotatably installed at the two side end portions PES of the paper P in positions of a distance d from the nip portion of the secondary transfer unit 172 along the conveyance path of the paper P.

In addition, an interval between the two rollers can be changed in response to the size of the paper P. Furthermore, the size of the paper P, for example, can be acquired from the paper width information preserved in the HDD of the control unit 200.

Each of the two rollers makes contact with the paper P such that its own rotating surface spans across the side end portion PES of the paper P, and rotates along the side end portion PES according to the conveyance of the paper P. In more detail, the roller rotates with a predetermined slide at the end portion PE of the paper P from which the adhesive G does not project. On the other hand, at a part from which the adhesive G projects, since a slide is suppressed by adhesive force of the adhesive G, the roller rotates with a slide smaller than the predetermined slide.

The encoder detects the rotation of the roller, outputs a signal of one pulse in each rotation, and transmits the signal to the control unit 200. The control unit 200 calculates the number of rotations of the roller based on the output of the encoder.

As shown in FIG. 11, the number of rotations of the roller may be changed while the roller is traveling along the side end portion PES of the paper P. This is because the sliding degrees of the roller differ in a part at which the adhesive projects from the end portion of the paper P and a part at which the adhesive does not project. In addition, the roller is coated with fluorine resin (for example, polytetrafluoroethylene) in order to suppress the attachment of an adhesive.

In the example shown in FIG. 11, the number of rotations of the roller is high in the part in which the adhesive projects from the end portion of the paper P because the slipping degree of the roller in the part, in which the adhesive projects from the end portion of the paper P, is lower than that in the part in which the adhesive does not project. The control unit 200 determines that there is an adhesive in the part in which the number of rotations of the roller is high, calculates the number of rotations in the part in which the number of rotations is high, and calculates the length of the part including the adhesive based on the number of rotations.

As described above, in the present embodiment, by using the roller having the rotating surface rotating along the end portion of the paper, the adhesive projecting from the end portion of the paper is detected from the difference of the number of rotations when the adhesive exists and when the adhesive does not exists. When it is determined that the adhesive exists, the control unit 200 decides the toner layer creation conditions based on the paper width information, the toner use history, and the position and length of the detected adhesive, and instructs the image forming unit 130 and the transfer unit 170 to create the toner layer.

The present embodiment has the following effects in addition to the effects of the first embodiment.

According to the present embodiment, since the roller of the detection unit 175 makes contact with the adhesive G to detect the adhesive G, even though it is difficult to distinguish the adhesive G from the paper P because the reflectance of the adhesive G is substantially equal to the reflectance of the paper P, it is possible to more reliably detect the adhesive projecting from the end portion of the paper P.

Example

In an example, an image has been printed on a label paper by using the image forming apparatus 100 of the first and second embodiments. Table 1 below shows an evaluation result of "image failure (black streaks)" and "contamination on intermediate transfer belt" of an image printed on the label paper by using the image forming apparatus 100 with respect to each of the first and second embodiments. Furthermore, Table 1 below also shows an evaluation result of an comparative example when an image has been printed on the label paper without using the image forming apparatus 100 of the present embodiment.

In the present example, after 10000 papers having an A4 size are continuously fed (about 2 km when it is converted into a distance), image failure (black streaks) and the attachment of an adhesive on the intermediate transfer belt 173 are visually observed, and "x" and "o" are respectively added when visual determination is possible and when the visual determination is not possible.

TABLE 1

| | Image failure (black streaks) | Contamination on intermediate transfer belt |
|---|---|---|
| Comparative example | x | x |
| Example (first embodiment) | o | o |
| Example (second embodiment) | o | o |

As shown in Table 1 above, the comparative example shows the "image failure (black streaks)" and the "contamination on intermediate transfer belt" which can be visually determined.

On the other hand, the example does not show the "image failure (black streaks)" and the "contamination on intermediate transfer belt" which can be visually determined.

As described above, in the embodiments, the image forming apparatus and the image forming method of the present invention have been described. However, it goes without saying that addition, modification, and omission can be appropriately made by those skilled in the art within the technical scope of the present invention.

For example, in the aforementioned first and second embodiments, the image forming apparatus employing the intermediate transfer scheme has been described. However, the present invention shall not be limited to the image forming apparatus of the intermediate transfer scheme, and the present invention can be applied to an image forming apparatus employing a direct transfer scheme. In the case of employing the direct transfer scheme, the control unit controls the paper conveying unit to convey a paper to the photosensitive drum capable of carrying an image and controls the foreign matter detection unit to detect a foreign matter projecting from the end portion of the paper. Then, the control unit controls the toner layer forming unit to form a toner layer on the surface of the photosensitive drum in response to the position of the foreign matter detected by the foreign matter detection unit.

Furthermore, in the aforementioned first and second embodiments, the case in which the foreign matter is an adhesive has been described. However, even though the foreign matter is cutting waste of a paper, rubbish, etc., it is possible to prevent the foreign matter from being attached to the member of the transfer unit by the configuration of the present invention.

What is claimed is:

1. An image forming apparatus comprising:

an image carrying member capable of carrying an image;

a paper conveying unit for conveying a paper to said image carrying member;

a foreign matter detection unit for detecting a foreign matter projecting from an end portion of said paper; and a toner layer forming unit for forming a toner layer on a surface of said image carrying member in response to a position of said foreign matter detected by said foreign matter detection unit.

2. The image forming apparatus as claimed in claim 1, further comprising:

a transfer unit for conveying said paper in press-contact with said image carrying member with said formed image and toner layer and transferring said image to said paper.

3. The image forming apparatus as claimed in claim 2, wherein a distance from said foreign matter detection unit to a nip portion of said transfer unit is longer than a distance from an image writing position to said image carrying member at a lowermost downstream side to said nip portion.

4. The image forming apparatus as claimed in claim 3, wherein said foreign matter detection unit acquires information including at least one of a width, a length, and an amount of said foreign matter projecting from said end portion of said paper, and said toner layer forming unit interprets said information and decides at least one of a width, a length, and a thickness of a toner layer to be formed.

5. The image forming apparatus as claimed in claim 1, wherein said foreign matter detection unit includes an optical sensor, and optically detects said foreign matter projecting from said end portion of said paper.

6. The image forming apparatus as claimed in claim 1, wherein said foreign matter detection unit includes a rotating member, said rotating member is rotatably installed along said end portion of said paper, and said foreign matter detection unit detects said foreign matter projecting from said end portion of said paper based on a number of rotations of said rotating member.

7. The image forming apparatus as claimed in claim 1, wherein said toner layer forming unit forms a toner layer having a predetermined width at an outer side of said paper from a position corresponding to said end portion of said paper on said surface of said image carrying member.

8. The image forming apparatus as claimed in claim 1, wherein said toner layer forming unit forms a toner layer from an inner side to an outer side across said position corresponding to said end portion of said paper on said surface of said image carrying member.

9. The image forming apparatus as claimed in claim 7, wherein said toner layer forming unit forms a single layer of toner layer or a plurality of stacked toner layers.

10. The image forming apparatus as claimed in claim 7, wherein said toner layer forming unit forms a large number of stacked toner as it goes toward said position corresponding to said end portion of said paper in said surface of said image carrying member.

11. The image forming apparatus as claimed in claim 1, wherein said toner layer forming unit forms said toner layer by using toner of a color with a small consumption amount.

12. The image forming apparatus as claimed in claim 1, wherein said image carrying member includes an intermediate transfer belt.

13. The image forming apparatus as claimed in claim 1, wherein said image carrying member includes a photosensitive drum.

14. The image forming apparatus as claimed in claim 1, wherein said paper includes an adhesive layer.

15. An image forming method comprising steps of:

conveying a paper to an image carrying member capable of carrying an image, and detecting a foreign matter projecting from an end portion of said paper; and forming a toner layer on a surface of said image carrying member in response to a position of said detected foreign matter.

16. The image forming method as claimed in claim 15, further comprising a step of:

conveying said paper in press-contact with said image carrying member and transferring said image to said paper.

17. The image forming method as claimed in claim 15, wherein said step of detecting said foreign matter comprises:

detecting optically said foreign matter projecting from said end portion of said paper.

18. The image forming method as claimed in claim 15, wherein said step of detecting said foreign matter comprises:

detecting said foreign matter projecting from said end portion of said paper based on a number of rotations of a rotating member rotatably installed along said end portion of said conveyed paper.

19. The image forming method as claimed in claim 15, wherein said step of forming said toner layer comprises:

forming a toner layer having a predetermined width at an outer side of said paper from a position corresponding to said end portion of said paper on said surface of said image carrying member.

20. The image forming method as claimed in claim 15, wherein said step of forming said toner layer comprises:

forming a toner layer from an inner side to an outer side across a position corresponding to said end portion of said paper on said surface of said image carrying member.

* * * * *